US005695174A

United States Patent [19]

Tsai

[11] Patent Number: 5,695,174

[45] Date of Patent: Dec. 9, 1997

[54] FENCE

[76] Inventor: Yang Wen Tsai, No. 31-6, Hou-Chuang Road, Pei-Tung Dist, Taichung City, Taiwan

[21] Appl. No.: 588,449

[22] Filed: Jan. 18, 1996

[51] Int. Cl.[6] ..... B21F 27/00

[52] U.S. Cl. ..... 256/22; 256/59; 256/67; 256/19; 52/155

[58] Field of Search ..... 256/24, 22, 19, 256/59, 65, 66, 67; 52/155, 156, 158, 159, 160, 165

[56] References Cited

U.S. PATENT DOCUMENTS

| | | | |
|---|---|---|---|
| 86,935 | 2/1869 | Middleton | 256/59 X |
| 165,557 | 7/1875 | Geer | 52/165 |
| 342,922 | 6/1886 | Munn | 52/165 |
| 427,815 | 5/1890 | Wolf | 52/155 |
| 1,153,450 | 9/1915 | Schaff | 52/155 |
| 3,648,982 | 3/1972 | Sabel et al. | 256/22 X |
| 3,879,017 | 4/1975 | Maxcy et al. | 256/22 X |
| 3,910,561 | 10/1975 | Fornells | 256/59 X |
| 3,924,834 | 12/1975 | Young | 256/59 X |
| 4,125,249 | 11/1978 | Zen | 256/67 |
| 4,369,953 | 1/1983 | Greiner et al. | 256/59 X |
| 4,752,060 | 6/1988 | McCluskey et al. | 256/59 |
| 4,809,955 | 3/1989 | Veilleux | 256/59 X |
| 5,026,028 | 6/1991 | Ooi et al. | 256/67 |
| 5,123,209 | 6/1992 | Nally | 52/165 X |
| 5,230,187 | 7/1993 | Reimann | 256/19 X |
| 5,362,030 | 11/1994 | Iler, Jr. et al. | 256/19 X |
| 5,396,743 | 3/1995 | Bellette | 52/155 X |
| 5,547,169 | 8/1996 | Russell | 256/59 X |
| 5,556,079 | 9/1996 | West | 256/19 X |

*Primary Examiner*—Anthony Knight
*Assistant Examiner*—Bruce A. Lev
*Attorney, Agent, or Firm*—Morton J. Rosenberg; David I. Klein

[57] ABSTRACT

A fence includes two posts which are fixedly planted into the ground by a wedge-shaped element, two plates connected between the two posts by a first connect in element disposed between each of the plates and the post wherein the plate is pivotally engaged to the first connecting element, each of the posts having a first groove defined longitudinally therein such that the first connecting. elements can be adjustably received therein, a plurality of balusters engaged to the two plates wherein a second connecting element is disposed between each of the balusters and the plates.

2 Claims, 4 Drawing Sheets

FENCE

BACKGROUND OF THE INVENTION

1. Field of the Invention

The present invention relates to a fence and more particularly, to a fence composed of two end posts between which at least one plate is adjustably connected and a plurality of balusters disposed to the plates. The fence of the invention provides a strong structure which is easily to be assembled.

2. Brief Description of the Prior Art

Conventionally, a fence is built around a garden of a house, one kind of the fence is made of wood plates which include two posts separately planted into ground and at least one plate horizontally connects between the two posts by nails and a plurality of balusters are nailed to the plate. Such a fence is simply planted into the ground and the depth of the posts inserting into the ground is limited such that the fence is easily be pulled out, furthermore, the configuration of the wood plates is hard to be designed for a common builder unless the builders has proper tools and enough time to shape them. In most area of the world, the decreasing forest becomes a serious problem and therefore protection of the forest is a main trend that every one should follow the trend and not to use the forest source as possible as one can be.

The present invention intend to provide an improved fence which is assembled easily and has proper designs to securely fixed into the ground and is easy to be adjusted therefore mitigates and/or obviates the above-mentioned problems.

SUMMARY OF THE INVENTION

The present invention provides a fence which includes two posts fixedly planted into the ground by a wedge-shaped element extending therefrom, two plates connected between the two posts by a first connecting element disposed between each of the plates and the post wherein the plate is pivotally engaged to the first connecting element. Each of the posts has a first groove defined longitudinally therein such that the first connecting elements can be adjustably received therein. A plurality of balusters are engaged to the two plates wherein a second connecting element is disposed between each of the balusters and the plates.

It is an object of the present invention to provide a fence is easily to be assembled.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
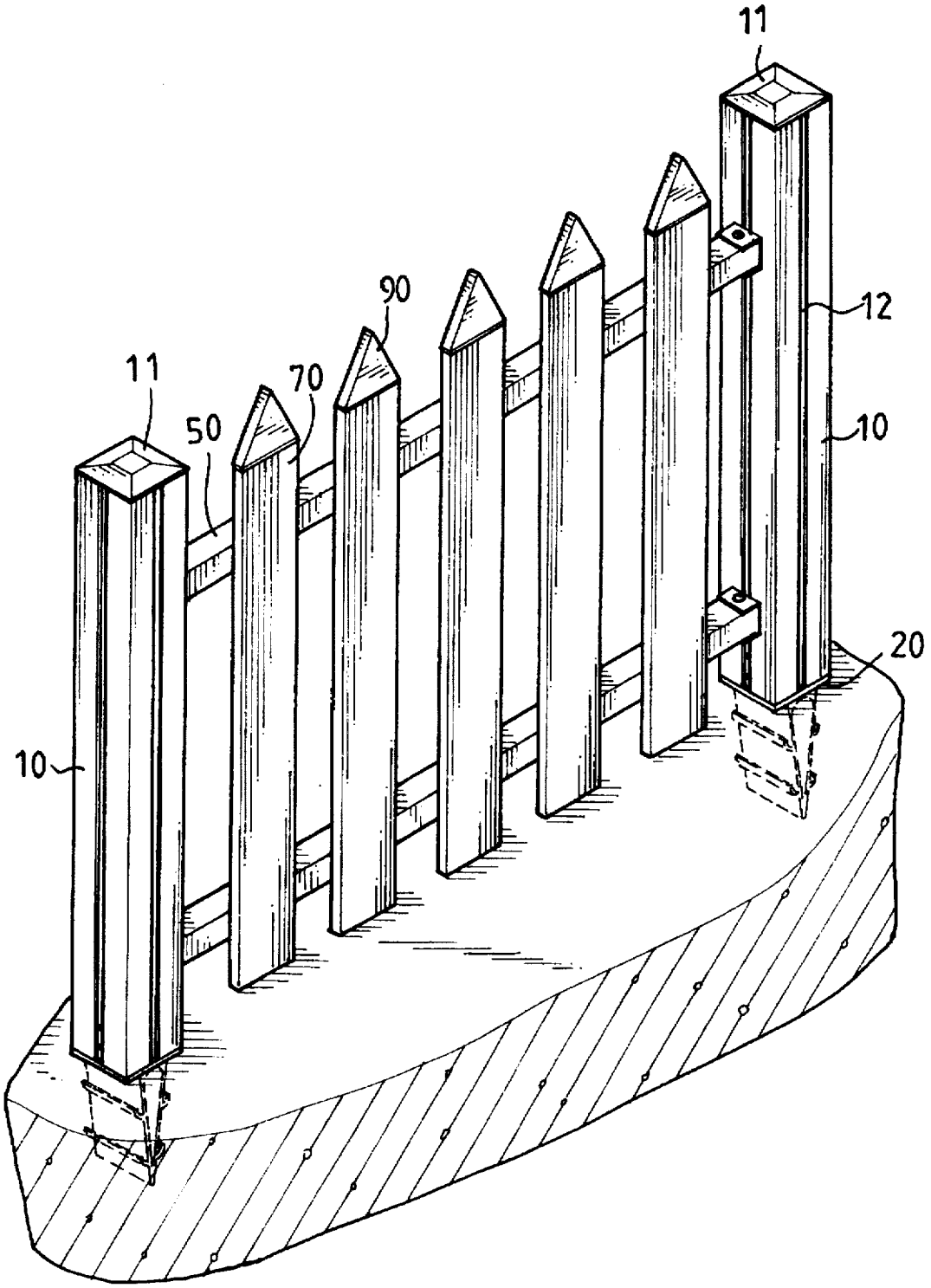
FIG. 1 is a perspective view of a fence in accordance with the present invention.
Figure 2:
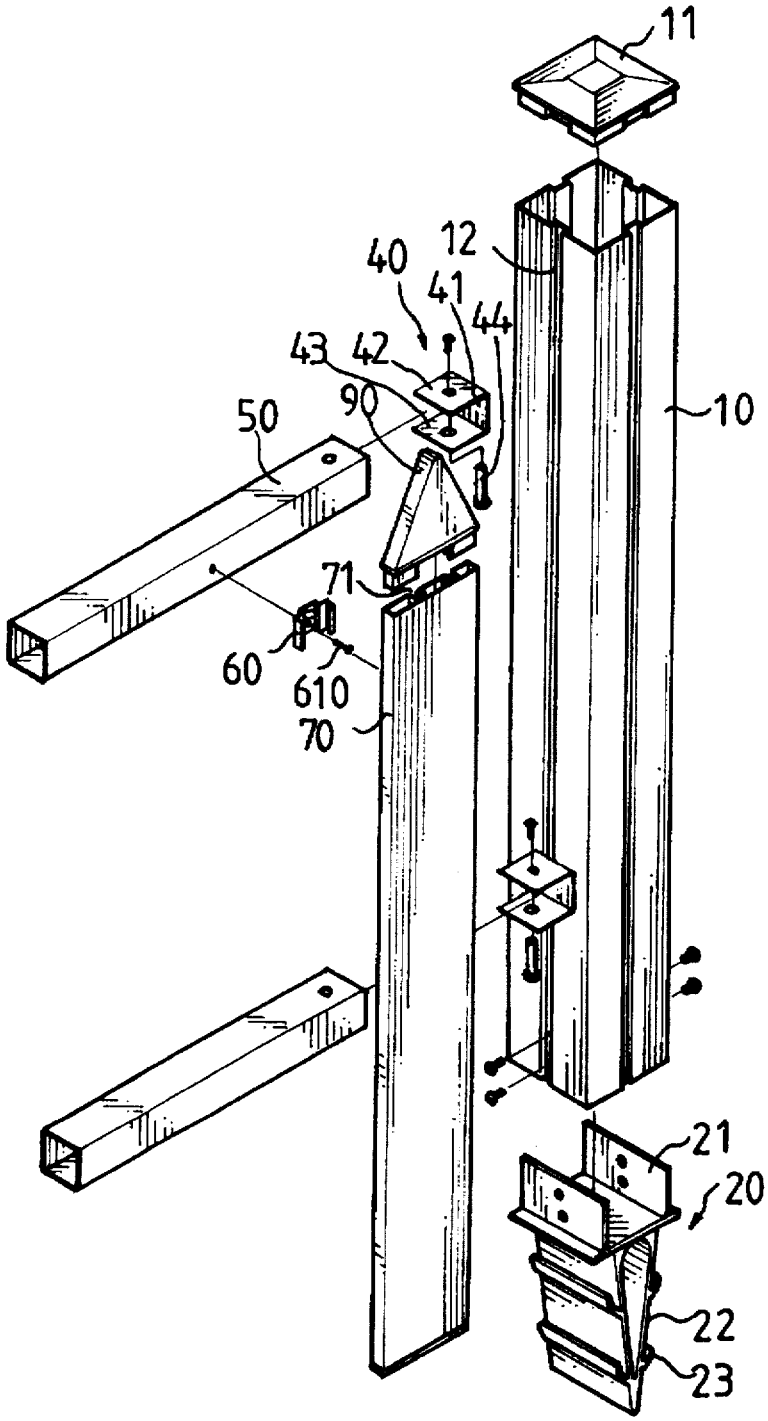
FIG. 2 is an exploded view of the fence in accordance with the present invention.
Figure 3:
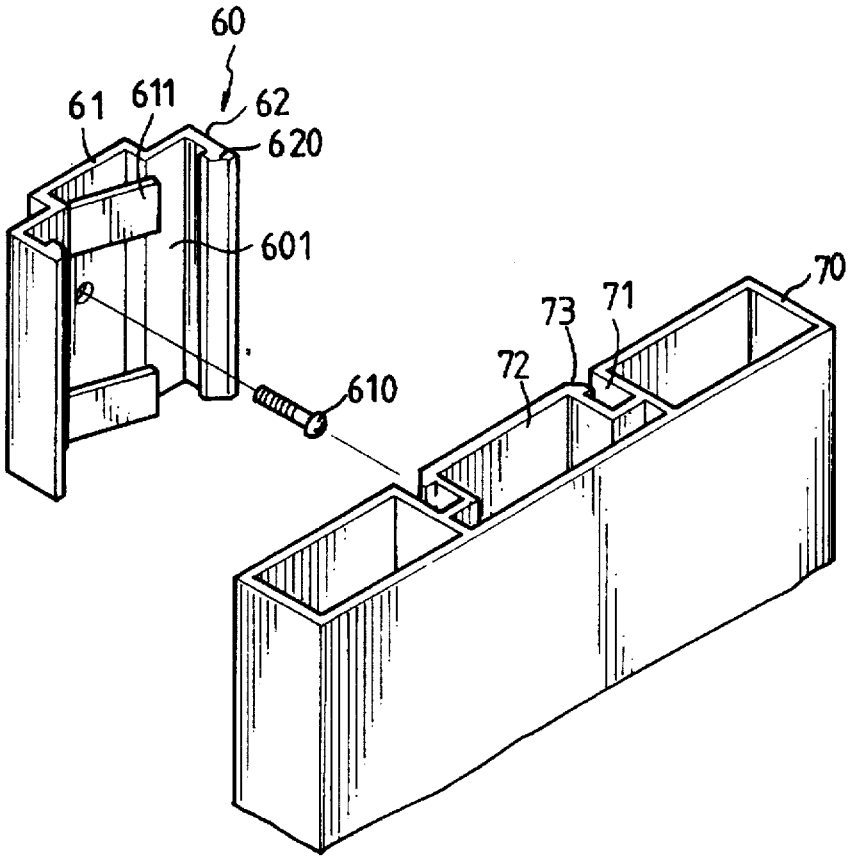
FIG. 3 is an exploded view of a second connecting element and the baluster in accordance with the present invention.
Figure 4:
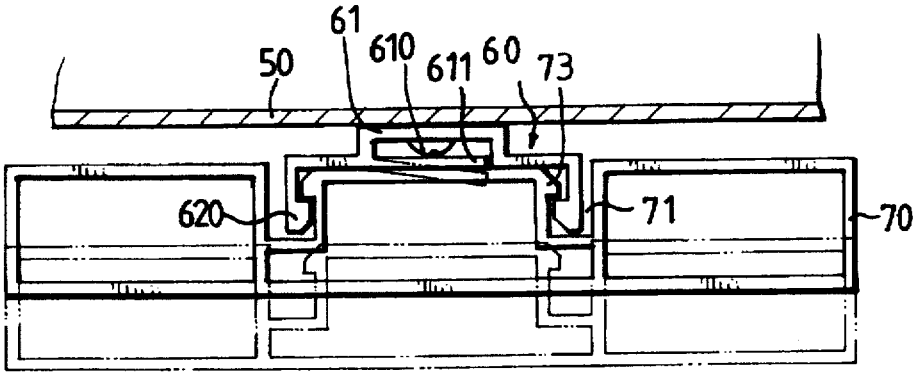
FIG. 4 is a top plan view, partly in section, of the baluster engaged to the plate by the second connecting element.

Referring to the drawings and initially to FIGS. 1 through 4, a fence in accordance with the present invention generally includes at least two posts 10, each one of the posts 10 having a first end and a second end, the first end thereof having a fixing element 20 disposed thereto and the second end thereof having a cap 11 mounted thereto. The fixing element 20 has two top plates 21 extending upwardly therefrom so as to be received in the first end of the post 10 and a wedge-shaped protrusion 22 extends downwardly from the fixing element 20, the wedge-shaped protrusion 22 having a plurality of ribs 23 extending inclindedly therefrom such that when said wedge-shaped protrusion 22 is inserted into the ground the ribs 23 inserted transversely into the soil to prevent from being pulled out from the ground. A first groove 12 is defined longitudinally in each side of the posts 10.

At least one first connecting element 40 has a middle portion 41 and two horizontal portions 42 extends separately from the middle portion 41, each of the horizontal portions 42 having a hole 43 defined therein. The first connecting element 40 is fixedly received in the first groove 12 corresponding thereto by bolts threading through the middle portion 41 and the post 10.

Figure 5:
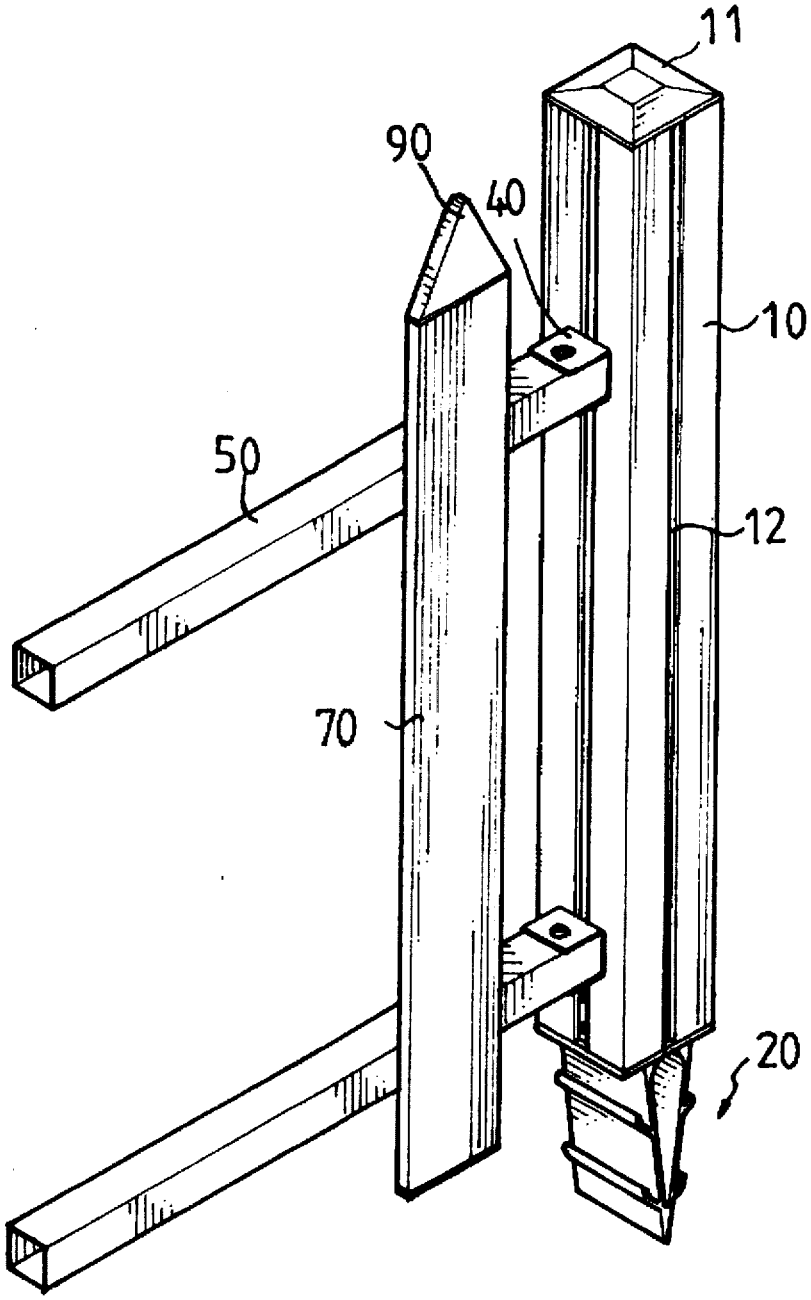
FIG. 5 is an illustrative view showing that the plate can be rotated about an axis of the post.

Two plates 50, each one of two ends of each of the plates 50 is pivotally received in the two horizontal portions 42 of the first connecting element 40 by extending a tube 44 through the two horizontal portions 42 via the hole 43 and the plate 50, a bolt engaged to a distal end of the tube 44 such that an angle corresponding to an axis of the posts 10 of the plates 50 can be adjusted when needed (FIG. 5).

A plurality of balusters 70 are engaged to the two plates 50, each of the balusters 70 having one side thereof with two second grooves 71 defined longitudinally therein and an engaging portion 72 formed between the two second grooves 71, the engaging portion 72 having a first hook portion 73 extending from each of the two sides thereof. The second connecting element 60 comprises a base plate 601 which has a side plate 62 extending from each one of two sides thereof and each of the side plates 62 has a second hook element 620 extending therefrom such that when the side plates 62 are inserted in the second grooves 71, the second hook elements 620 engage to the first hook elements 73. The second connecting element 60 has a central portion 61 extending from the base plate 601 and has two flexible plates 611 extending from an inner side of the central portion 61 such that when the second connecting element 60 is engaged to the baluster 70, a bolt 610 extends through the central portion 61 and engages to the plate 50 and the flexible plates 611 are depressed to contact against the engaging portion 72. A decoration element 90 is engaged to a top of each of the balusters 70.

Accordingly, the fence can be made by plastic material or metal such as aluminum and needs not to be nailed by the assembler, any one is able to assemble with ease. Furthermore, the plates 50 is pivotally engaged to the posts 10 such that the fence is easy to enclose a required configuration.

Although the invention has been explained in relation to its preferred embodiment, it is to be understood that many other possible modifications and variations can be made without departing from the spirit and scope of the invention as hereinafter claimed.

What is claimed is:

1. A fence comprising:

at least two posts, each of said posts having a first end and a second end, said first end thereof having a fixing element extending therefrom, said second end having a cap mounted thereto, each of said posts having at least one first groove formed longitudinally therein;

at least one pair of first connecting elements, each of said first connecting elements having a middle portion coupled to a respective one of said two posts and a pair of horizontal portions respectively extending from opposing ends of said middle portion, each of said horizontal portions having a hole formed therethrough;

at least one plate, said plate having opposing ends thereof respectively pivotally coupled to said pair of first connecting elements, each of said opposing ends of said plate being received between said pair of horizontal portions of a respective first connecting element; and, at least one baluster fixedly engaged to said plate by second connecting element, said baluster having two second grooves formed longitudinally in one side thereof and an engaging portion formed between said two second grooves, said engaging portion having a first hook element extending from each of two sides thereof, said second connecting element having a base plate and a pair of side plates respectively extending from opposing sides of said base plate, each of said side plates having a second hook element extending therefrom for engagement with a respective one of said first hook elements, said second connecting element being engaged to said plate be a bolt extending therethrough.

2. The fence as claimed in claim 1 wherein said second connecting element has a central portion extending from said base plate and has two flexible plates extending from an inner side of said central portion.

* * * * *